United States Patent [19]

Paradise et al.

[11] Patent Number: 4,872,647

[45] Date of Patent: Oct. 10, 1989

[54] DECORATIVE ATTACHMENT FOR A CHAIN LINK FENCE

[76] Inventors: Francis M. Paradise; James R. Paradise, both of 134-11 Hillside Ave., Jamaica, N.Y. 11418

[21] Appl. No.: 102,036

[22] Filed: Sep. 29, 1987

[51] Int. Cl.[4] ..... E04H 17/00

[52] U.S. Cl. ..... 256/1; 256/20; 256/32; 256/34

[58] Field of Search ..... 256/34, 20, 45, 1, 32, 256/23; 428/18, 20, 17

[56] References Cited

U.S. PATENT DOCUMENTS

| | | | |
|---|---|---|---|
| 84,180 | 11/1868 | Fletcher, Sr. | 256/34 X |
| 2,389,395 | 11/1945 | Tholstrup | 256/12.5 |
| 2,753,156 | 7/1956 | Rieger | 256/34 X |
| 3,118,424 | 1/1964 | Willinger | 428/17 X |
| 3,343,357 | 9/1967 | Goodridge | 428/18 X |

FOREIGN PATENT DOCUMENTS

| | | | |
|---|---|---|---|
| 2469501 | 5/1981 | France | 256/1 |
| 501882 | 11/1954 | Italy | 428/18 |
| 59338 | 4/1912 | Switzerland | 256/1 |

*Primary Examiner*—Andrew V. Kundrat

*Attorney, Agent, or Firm*—Bauer & Schaffer

[57] ABSTRACT

An assembly of a hedge-like element and a chain link fence is formed of a multitude of densely packed, relatively stiff leaf-like filaments are carried in elongated support to extend therefrom in a planar brush-like array. When a plurality of the camouflage elements are inserted in openings of the fence, the fence resembles a bush or hedge.

5 Claims, 1 Drawing Sheet

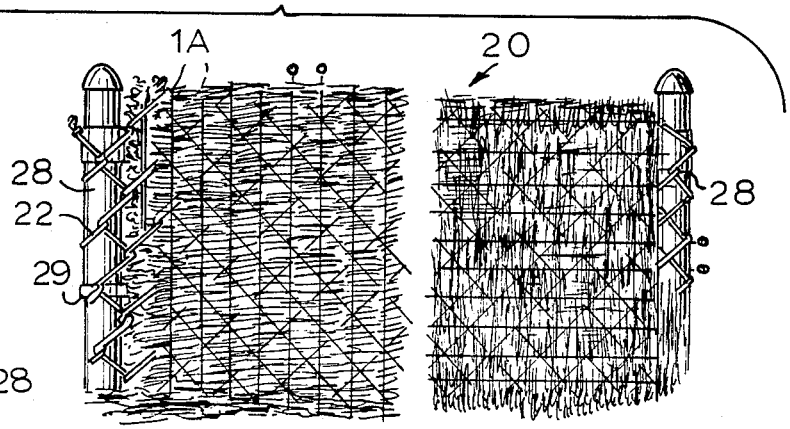
Fig. 4
Fig. 5
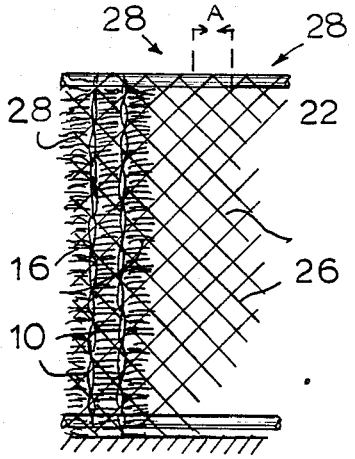
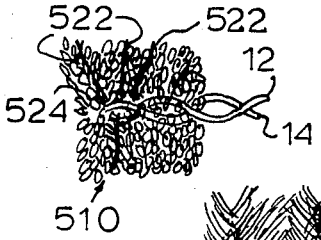
Fig. 6
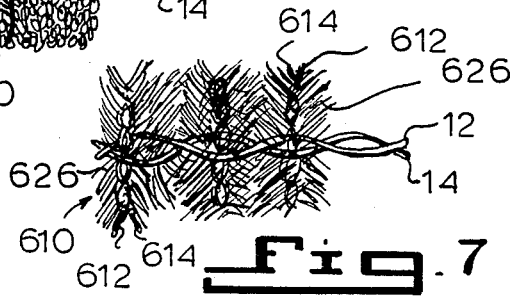
Fig. 7
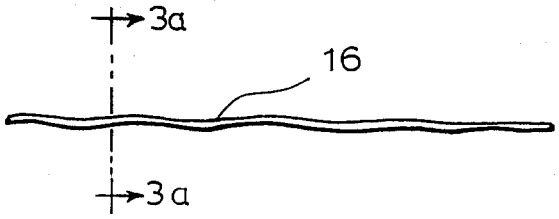
Fig. 3
Fig. 3a
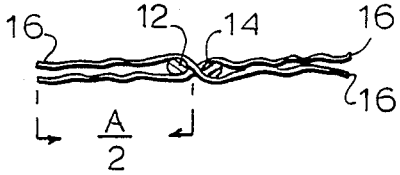
Fig. 2
Fig. 1
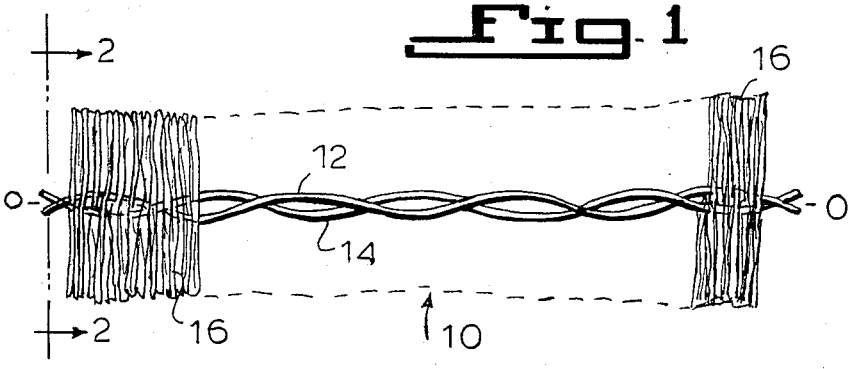

DECORATIVE ATTACHMENT FOR A CHAIN LINK FENCE

BACKGROUND OF THE INVENTION

The present invention relates to a decorative attachment for a chain link fence, and more particularly to an attachment that makes the fence look hedge-like.

The prior art shows numerous constructions that are designed to make a chain link fence more decorative and better suited for privacy. Reference, for example, can be made to U.S. Pat. Nos. 4,512,556; 3,572,640; and 2,802,645. Generally these constructions are in the form of slats that are inserted in the interwoven openings of the fence. While these slats make the fence more suited for privacy and act as an efficient windbreak, their presence makes the fence more noticeable and thic can detract from the appearance of the property. Earlier, it has been suggested to support live hedge fences by actually growing live shrubbery on chicken wire or mesh supporting fences; see, for example, U.S. Pat. Nos. 416,826 and 2,278,898. These constructions are overly expensive to construct and are neither fence nor hedge.

It is an object of the present invention to provide a decorative attachment for a chain link fence to make the same to appear as a real hedge.

It is another object of the present invention to provide a camouflage element that readily attaches to a chain link fence, has the same shrub-like appearance when viewed from either side of the fence, and blocks passage of light therethrough.

It is a further object of the present invention to provide a detachable element for a chain link fence that, when attached to the fence, acts to conceal the same, is easy to apply and will not be detached by severe wind, and that is low in cost.

These and other objects and features of the present invention will become apparent from the following disclosure.

SUMMARY OF THE INVENTION

The present invention overcomes the above noted drawbacks and provides a means that, when viewed from a relative close distance, gives a chain link fence the look of a hedge or greenery. In general, the present invention comprises, in assembly with a chain link fence, a plurality of elongated pseudo-life like camouflage elements interwoven parallel to each other in the adjacent aligned horizontal or vertical openings of the chain link fence.

In particular, the assembly comprises camouflage elements formed of relatively long wires that have secured to them a multitude of relatively stiff leaf-like filaments that extend laterally therefrom along the entire axial length. Preferably, the camouflage elements are made of a pair of twisted wires wherein the leaf-like filaments are captured within the twists, in dense bush-like fashion to form an essentially planar array having a discrete appearance of a section of hedging.

A plurality of these discrete camouflage elements are then inserted in given openings of the chain link fence so that the confronting ends of adjacent filaments overlap or touch. In this manner, the planar face of the fence is filled with the inventive inserts whereby some of the filaments extend from one side of the fence and others extend from the other side of the fence. With this construction, the decorative appearance of the fence is improved by rendering the fence hedge-like, and the fence functions to block sight therethrough, and to act as a wind break.

Full details of the present invention are set forth in the following description:

BRIEF DESCRIPTION OF THE DRAWINGS

In the drawings:

FIG. 1 is a diagrammatic perspective view of one hedge-like camouflage element according to the present invention;

FIG. 2 is a view along the line 2—2 of FIG. 1 showing the substantially planar construction of the hedge-like element;

FIG. 3 is an enlarged diagrammatic plan view of a single one of the many filaments or brush-like bristles that comprise the element seen in FIG. 1;

FIG. 3*a* is a sectional view of the bristle taken along lines 3*a*—3*a* of FIG. 3;

FIG. 4 shows the hedge-like camouflage element of FIG. 1 applied vertically and horizontally to a conventional chain link fence;

FIG. 5 is an enlarged view of the chain link fence shown in FIG. 4 illustrating the application of the present invention thereto.

FIG. 6 is another embodiment of a hedge-like element according to the present invention; and FIG. 7 is a further embodiment of a hedge-like element.

DESCRIPTION OF THE INVENTION

The overall purpose of the present invention is illustrated broadly in FIGS. 4 and 5. A plurality of hedge-like camouflage elements, generally depicted by the numeral 10 of elongated unitary form, are intertwined in the openings of a chain link fence, generally depicted by the numeral 20, so as to provide a complete pseudo-real hedge fence.

In detail, as seen in FIGS. 1–3a one embodiment of the decorative or hedge-like camouflage element 10 comprises a pair of elongated wires 12 and 14 that are twisted together along their longitudinal length thus defining a central elongated support axis. A multitude of elongated relatively stiff filaments or bristle-like members 16 are each substantially centrally held and captured in the twists or wires 12 and 14, along the support axis 0. Filaments 16 extend or radiate laterally of wires 12 and 14 along the entire axial length of the twisted pair in a bush-like rotative array, as seen in FIG. 2. Filaments are densely packed or closely spaced in the twists, along the support axis defined by wires 12 and 14.

The exact spacing of the twists, the spacing or intervals, and the number of filaments 16 arrayed along the length of the support axis, are not critical, and it will be understood that the drawings is illustrative only. Thus, multiple twists spaced between lesser twists and clumps of filaments spaced between single filaments may, if desired, for any decorative effect, be used.

For the purposes of illustration only, and as seen on an enlarged scale in FIG. 3 and 3*a*, each one of filaments 16 has a thin rectangular cross section. But, the cross-sectional configuration of each filament 16 is not critical and they can take nearly any shape provided they simulate a hedge or leaf-like substance. For example, each filament can have a circular or oval cross section, or a cross section that tapers. An important criteria is that overall filament density or packing be high, and that the filaments be relatively stiff and life-like so as to bridge and cover the openings in the chain link fence 20, as seen in FIG. 4. The filament 16 may be made of rigid polyvinyl cloride (P.V.C.) suitable for outdoor use.

The hedge-like camouflage element 10 is inserted with the support axis 0 parallel to each other in vertically or horizontally aligned rows of openings 18 of fence 20 as seen in FIG. 5. As is well known, a chain link fence is formed of a plurality of interlocking steel wires 22 and 24 twisted together at uniform cross over intervals 26 forming a plurality of diamond shaped openings 18, constituting a mesh in which the openings 18 communicates in diagonally oriented channels indicated by arrows 28. Interweaving of the camouflage elements does not follow the channels 28, but crosses these channels from diamond apex to diamond apex, row by row, of each diamond, so that each camouflage element 10 lies parallel to the other, either vertically to the ground or horizontally to the ground. As the camouflage element 10 is pulled and/or pushed vertically and/or horizontally through the openings 18, i.e., behind one cross over interval 26 and over the next interval 26, through each of the channels 28, the filaments 16 bend and then tend to automatically straighten as they enter a given opening 18. Manual fluffing of filaments 16 will tend to brush out any filaments 16 that remain other than essentially perpendicular from the support axis defined by wires 12 and 14. Preferably the length of a given filament from its center, where it is held by the twist of wires 12 and 14, outward to a lateral tip is at least approximately half the diagonal length 'A' of the defined opening 18 in a chain link fence 20.

As adjacent horizontal or vertical openings 18 in the fence are filled with respective camouflage elements 10, the thus covered fence takes on the appearance of real greenery or shrubbery. Some of filaments 16 will be on one side of the fence and other filaments will be on the other side of the fence. It is preferable that the camouflage element be inserted in and adjacent, i.e. directly or next adjacent vertical or horizontal row of openings, although if the actual leaf-like filament is sufficiently large and stiff, alternate parallel rows only need be filled. Confronting tips or end regions of adjacent filaments will overlap and interengage further to enhance the camouflage and light-blocking effect.

Referring now to FIG. 6 there is shown another form of a camouflage element according to the present invention seen generally as reference numeral 510. A pair of twisted wires 12 and 14 support a plurality of laterally extending densely packed stems 522. A plurality of mini-leaves or flat privets 524 extend essentially laterally of a respective stem 522 as shown. Similar to element 10, element 510 has, when viewed edgewise, a flat, planar construction. With this configuration, camouflage element 510 more closely resembles actual privet shrubbery.

Use and operation of element 510 is substantially similar to that described above with reference to element 10 and FIG. 5.

Referring now to FIG. 7 there is shown one more embodiment of the present invention seen generally as reference numeral 610. Camouflage element 610 comprises the same element as seen in FIG. 1 consisting of twisted wire pair 12 and 14 and densely packed filaments 16. In addition, element 610 includes a plurality of relatively closely spaced transverse elements 626 each one of which is held by the twists of wire pair 12 and 14 such that each transverse element 626 extends laterally from the axis defined by wires 12 and 14. Each transverse element itself includes a pair of twisted wires 612 and 614 that support a plurality of densely packed laterally extending filaments 616, in all respects similar to filaments 16 described above.

Use and operation of the embodiment of FIG. 7 is similar to that described above with reference to FIG. 5 and 6 except that as element 610 is pulled through openings 18, transverse elements 626 will bend. After element 610 is placed in the fence, elements 626 should be repositioned so as to be generally perpendicular to the longitudinal support axis defined by wire 12 and 14.

Preferably, the elongate axial length of wires 12 and 14 and hence the length of element 10, or elements 510 and 610 will be approximately the same length as the distance between support posts 28 of fence 20, if interleaved horizontally in the chain apertures; or be of a length equal to approximately the height of the fence, if carried vertically thereon. For best results, the given camouflage elements should all run vertically or all run horizontally although a criss-cross pattern may also be developed. Diagonal arrangement of the camouflage elements 10 should be avoided since in such an arrangement, large parallel spaces between elements tend to be created, notwithstanding the transverse length of the filaments 16. The various camouflage elements will, preferably, be colored green or other hues so as to resemble shrubbery or plants. Filaments 16 and stems 522 can be made of plastic. Indeed, the entire camouflage element, such as element 10 can be made from plastic with filaments 16 bonded to or integrally formed with a centrally disposed longitudinal support axis or rod, without the use of wire supports.

While only a few embodiments of the present invention have been shown and described, it is to be understood that many changes and modifications can be made hereto without departing from the spirit and scope hereto.

What is claimed is:

1. An artificial hedge and/or shrubbery assembly comprising a chain link fence having a plurality of interlocking wires twisted together at spaced intervals to form a plurality of diamond shaped openings arranged in parallel rows, and a plurality of camouflage assemblies supported on said fence said camouflage assemblies comprising a central elongated axial support element and relatively stiff densely packed filament means fixedly carried by said support element and extending laterally of the axis thereof, said filament means forming a bush-like planar array that extends along the entire length of said support element, at least one of said camouflage assemblies being inserted in a selected plurality of rows of openings in said fence such that said support element passes through the openings in said selected rows so that when a plurality of such elements are thus inserted the fence assumes a hedge-like appearance.

2. A decorative element for use with a chain link fence comprising a pair of twisted elongate wires, a multitude of elongate filaments carried in said twisted pair of wires, said wires being twisted so that, said filaments are densely packed contiguously one to the other, said filaments being relatively stiff and extending essentially laterally of the longitudinal axis defined by said twisted pair of wires such that said filaments present a generally planar hedge-like array whereby when a plurality of such elements are passed through selected ones of the apertures of the fence, the fence is simulative of shrubbery, and with said filaments being in the form of stems, each one of said stems carrying a plurality of leaf-like privets.

3. A decorative element for use with a chain link fence comprising a pair of twisted elongate wires, a multitude of densely packed, elongate filaments carried in said twisted pair, said filaments being relatively stiff and extending essentially laterally of the longitudinal axis defined by said twisted pair such that, in edge view, said filaments present a generally bush-like array whereby when a plurality of such elements are passed through selected ones of apertures of the fence, the fence is simulative of shrubbery, each of said transverse elements being formed of a second twisted pair of wires and a multitude of densely packed, relatively stiff filaments carried on each of said second twisted pair and extending laterally thereof in a bush-like array that, in edge view, is essentially planar, each of said second twisted pair having an axial length that is essentially shorter than said twisted pair and carried thereon so as to be essentially perpendicular thereto.

4. In combination a decorative attachment for a wire fence of the type having oppositely diagonally oriented interwoven lengths of wire bounding plural openings therebetween arranged in orthognal rows, said decorative attachment comprising a length of a cooperating pair of wires twisted lengthwise about each other with laterally extending plastic fibers engaged in the twists thereof, said plastic fibers being densely packed contiguously one the other such that said filaments present a generally planar hedge-like array, a pair of said twisted wire lengths being threaded through a selective row of openings in said fence, each of said twisted wire lengths having an operative position when threaded through a row of said plural fence openings establishing an attached relation to said fence and incident to the attaining of said operative position such that said engaged plastic fibers bend against said wire length in the direction of the threading thereof through said fence openings so as to pass through said openings, and said plastic fibers thereafter move under the bias of the resiliency of the plastic construction material thereof into positions extending laterally of said twisted wire length, to substantially cover the corresponding openings in said fence whereby said attached twisted wire length decorates said fence and said plastic fibers thereof contribute to the privacy of said fence by occluding the openings thereof.

5. In combination a decorative attachment for a wire fence of the type having oppositely diagonally oriented interwoven lengths of wire bounding plural openings therebetween arranged in orthognal rows, said decorative attachment comprising a length of a cooperating pair of wires twisted lengthwise about each other with laterally extending plastic fibers engaged in the twists thereof, said plastic fibers being densely packed contiguously one the other such that said filaments present a generally planar hedge-like array, said openings being rectangular and said twisted wire lengths are threaded diagonally through said openings across a plurality of said rows, each of said twisted wire lengths having an operative position when threaded through a row of said plural fence openings establishing an attached relation to said fence and incident to the attaining of said operative position such that said engaged plastic fibers bend against said wire length in the direction of the threading thereof through said fence openings so as to pass through said openings, and said plastic fibers thereafter move under the bias of the resiliency of the plastic construction material thereof into positions extending laterally of said twisted wire length, to substantially cover the corresponding openings in said fence whereby said attached twisted wire length decorates said fence and said plastic fibers thereof contribute to the privacy of said fence by occluding the openings thereof.

* * * * *

US004872647B1

REEXAMINATION CERTIFICATE (1782nd)

United States Patent [19]

[11] B1 4,872,647

Paradise et al.

[45] Certificate Issued Sep. 1, 1992

[54] DECORATIVE ATTACHMENT FOR A CHAIN LINK FENCE

[75] Inventors: Francis M. Paradise; James R. Paradise, both of Jamaica, N.Y.

[73] Assignee: American Permahedge, Inc., Ronkonkoma, N.Y.

Reexamination Request:
No. 90/002,697, Apr. 10, 1992

Reexamination Certificate for:

| | |
|---|---|
| Patent No.: | 4,872,647 |
| Issued: | Oct. 10, 1989 |
| Appl. No.: | 102,036 |
| Filed: | Sep. 29, 1987 |

[51] Int. Cl.[5] ..... E04H 17/00

[52] U.S. Cl. ..... 256/1; 256/20; 256/32; 256/34

[58] Field of Search ..... 256/34, 20, 45, 1, 32, 256/23; 428/18, 20, 17

[56] References Cited

U.S. PATENT DOCUMENTS

| | | | |
|---|---|---|---|
| 84,180 | 11/1868 | Fletcher, Sr. | 256/34 X |
| 2,278,898 | 4/1942 | Schofield . | |
| 2,351,142 | 6/1944 | Mitchell . | |
| 2,389,395 | 11/1945 | Tholstrup | 256/12.5 |
| 2,753,156 | 7/1956 | Rieger | 256/34 X |
| 3,118,424 | 1/1964 | Willinger | 428/17 X |
| 3,343,357 | 9/1967 | Goodridge | 428/18 X |
| 3,594,260 | 7/1971 | Dieffenbach . | |
| 3,672,638 | 6/1972 | Krebs . | |
| 3,810,496 | 5/1974 | Rohrbacher . | |
| 3,834,976 | 9/1974 | Mottel . | |
| 3,865,676 | 2/1975 | Bogart et al. . | |
| 4,512,556 | 4/1985 | Meglino . | |

FOREIGN PATENT DOCUMENTS

| | | | |
|---|---|---|---|
| 2743114 | 9/1977 | Fed. Rep. of Germany . | |
| 2469501 | 5/1981 | France | 256/1 |
| 501882 | 11/1954 | Italy | 428/18 |
| 59338 | 4/1912 | Switzerland | 256/1 |
| 2063067 | 6/1981 | United Kingdom . | |

*Primary Examiner*—Andrew V. Kundrat

[57] ABSTRACT

An assembly of a hedge-like element and a chain link fence is formed of a multitude of densely packed, relatively stiff leaf-like filaments are carried in elongated support to extend therefrom in a planar brush-like array. When a plurality of the camouflage elements are inserted in openings of the fence, the fence resembles a bush or hedge.

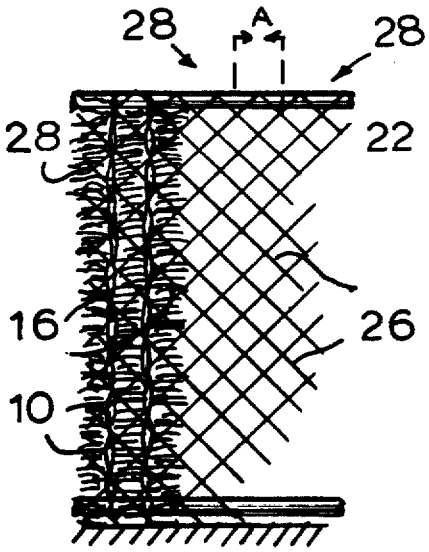

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-5 is confirmed.

* * * * *